US010959490B1

(12) United States Patent
Gomez

(10) Patent No.: US 10,959,490 B1
(45) Date of Patent: Mar. 30, 2021

(54) CHAMELEON SOLE FOOTWEAR APPARATUS

(71) Applicant: Abdul Luke Gomez, San Diego, CA (US)

(72) Inventor: Abdul Luke Gomez, San Diego, CA (US)

( * ) Notice: Subject to any disclaimer, the term of this patent is extended or adjusted under 35 U.S.C. 154(b) by 0 days.

(21) Appl. No.: 17/073,320

(22) Filed: Oct. 17, 2020

(51) Int. Cl.

| | |
|---|---|
| ***A43B 3/24*** | (2006.01) |
| ***A43B 13/36*** | (2006.01) |
| ***A43B 13/37*** | (2006.01) |
| ***A43B 13/16*** | (2006.01) |
| ***A43B 13/30*** | (2006.01) |

(52) U.S. Cl.
CPC ..... *A43B 13/36* (2013.01); *A43B 3/24* (2013.01); *A43B 3/244* (2013.01); *A43B 3/246* (2013.01); *A43B 13/16* (2013.01); *A43B 13/30* (2013.01); *A43B 13/37* (2013.01)

(58) Field of Classification Search
CPC ..... A43B 13/36; A43B 13/30; A43B 13/16; A43B 3/24; A43B 3/244; A43B 3/246
USPC ..... 36/100, 101, 15
See application file for complete search history.

(56) References Cited

U.S. PATENT DOCUMENTS

| | | | | | |
|---|---|---|---|---|---|
| 2,368,960 | A * | 2/1945 | Anson | A43B 13/28 | 36/15 |
| 2,519,108 | A * | 8/1950 | Bryant | A43B 3/24 | 36/12 |
| 3,016,630 | A * | 1/1962 | Twiggs, Jr. | A43B 3/122 | 36/101 |
| 3,019,534 | A * | 2/1962 | Kauffman | A43B 13/36 | 36/15 |
| 4,606,139 | A * | 8/1986 | Silver | A43B 13/36 | 36/100 |
| 4,936,028 | A * | 6/1990 | Posacki | A43B 13/36 | 36/15 |
| 5,339,543 | A * | 8/1994 | Lin | A43B 3/24 | 36/100 |
| 5,992,058 | A * | 11/1999 | Jneid | A43B 3/122 | 36/100 |
| 2004/0221486 | A1* | 11/2004 | Dennison | A43B 7/18 | 36/31 |
| 2008/0222920 | A1* | 9/2008 | Rovida | A43B 5/18 | 36/100 |
| 2008/0301978 | A1* | 12/2008 | Colella | A43B 3/24 | 36/101 |
| 2018/0146740 | A1* | 5/2018 | Berberian | A43B 7/1435 | |
| 2018/0338582 | A1* | 11/2018 | Berberian | A43B 7/1435 | |
| 2019/0059505 | A1* | 2/2019 | Ohlin | A43B 3/248 | |

* cited by examiner

*Primary Examiner* — Marie D Bays
(74) *Attorney, Agent, or Firm* — Oliff PLC

(57) ABSTRACT

A footwear sole apparatus which has a base member and at least one insert (principal insert and/or heel insert) as well as one or more fail-safe interconnectivity mechanisms, comprised of a configuration to fit or replace the sole or partial sole of a pair or pairs of footwear. The base member is either pre-attached to a new shoe(s) or fitted onto the sole of an existing shoe(s). The base member can be attached to the insert(s), having one or more fail-safe mechanisms to enhance interconnectivity of the base member and insert(s).

17 Claims, 4 Drawing Sheets

CHAMELEON SOLE FOOTWEAR APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ONA COMPACT DISC

Not Applicable

BACKGROUND OF THE INVENTION

1. Field of the Invention

The present invention relates generally to footwear and more specifically it relates to a novel footwear sole apparatus that allows the wearer to interchange different soles or sole parts using the same pair of footwear thus changing footwear sole functionality and increasing the versatility, longevity and comfort of a single pair or multiple pairs of shoes depending on the consumer s needs.

2. Description of the Related Art

Any discussion of the prior art throughout the specification should in no way be considered as an admission that such prior art is widely known or forms part of common general knowledge in the field.

Footwear has been in use for years. It was created to provide protection and comfort to the human foot. The sole is the bottommost part of the shoe or footwear. Typically, consumers purchase new footwear once their current footwear soles wear out, for safety, comfort and/or aesthetic reasons. Consumers also purchase different pairs of shoes based upon the specific type of sole that each pair distinctly offers such as spiked soled shoes for golf or track running, cleat soled shoes for soccer or football, traction-enhanced soles for trail running, corrective soled shoes to address foot related conditions, etc.

Current footwear soles are not suitable because they are not customizable. Per the examples in the previous paragraph, consumers must purchase multiple pairs of shoes to participate in diverse activities. Once the sole on a favorite pair of shoes wears out, it is typically thrown away even though the upper might still be in good condition and despite the fact that the shoe might otherwise be of great comfort and/or sentimental value to the consumer.

A prior art example upon which this current concept builds is that of sole savers, also known as sole protectors, sole guards, toe taps, or sole grips. These generally constitute protective pads that are attached to the bottom of a shoe by a cobbler or shoe owner, designed to increase the longevity of usefulness of the shoe soles, preserve aesthetic appearance over time, and prevent slipping during wear. The limitations of this art are the fact that adding a new piece onto the existing shoe makes the shoe heavier and stiffer, thus reducing comfort when compared to the original. The same disadvantage applies when having a cobbler entirely resole a shoe; the original feel and fit of the shoe is inevitably altered. With sole savers, there is no option to completely replace the shoe sole, so a shoe owner cannot currently convert a shoe bottom from, for example, a jogging sole to a hiking boot sole, thus hampering its versatility and forcing the shoe owner to continue buying new pairs to serve diverse purposes.

With the Chameleon Sole footwear apparatus, one pair of shoes can now serve numerous functions instead of a consumer having to buy multiple pairs of footwear. With just one pair of shoes, the consumer can change the entire sole or parts of the sole to accommodate his/her needs or preferences. Just as a chameleon can change color to reflect its mood, help adjust to different temperatures, or to blend into its environment, so too can the Chameleon Sole be changed to reflect the preferences and needs of the consumer.

In these respects, the Chameleon Sole footwear apparatus according to the present invention substantially departs from the conventional concepts and designs of the prior art, and in so doing provides an apparatus primarily developed for the purpose of changing footwear sole functionality and increasing the versatility, longevity, and comfort of a single pair or multiple pairs of footwear.

BRIEF SUMMARY OF THE INVENTION

In view of the foregoing disadvantages inherent in the known types of footwear, sole savers and shoe soles now present in the prior art, the present invention provides a new footwear sole apparatus wherein the same can be utilized for improving footwear sole functionality and increasing the versatility, longevity and comfort of footwear. The general purpose of the present invention, which will be described subsequently in greater detail, is to provide a new footwear sole apparatus that has many of the advantages of the standard shoe sole mentioned heretofore and many novel features that result in a new footwear sole apparatus which is not anticipated, rendered obvious, suggested, or even implied by any of the prior art footwear utility patents, either alone or in any combination thereof.

To attain this, the present invention generally comprises a base member and at least one insert (principal insert and/or heel insert) wherein said base member can be attached to said insert(s), having one or more failsafe mechanisms to enhance interconnectivity of the base member and insert(s), and wherein said base member is comprised of a configuration to fit or replace the sole or partial sole of a pair or pairs of footwear.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. A Iso, it is to be understood that the phraseology and terminology employed herein are for the purpose of the description and should not be regarded as limiting.

A primary object of the present invention is to provide a footwear sole apparatus that will overcome the shortcomings of the prior art shoe soles and sole savers, changing footwear sole functionality.

A second object is to provide an improvement to the versatility of footwear.

A further object is to provide an improvement to the longevity of footwear.

Another object is to provide a footwear apparatus that improves the duration of consumer comfort with a preferred pair or pairs of shoes.

A further object is to maintain the aesthetic appearance of a pair or pairs of shoes over time.

A n additional object of the present invention is to provide a footwear apparatus that meets the needs of consumers with orthopedic issues or disabilities.

Another object is to provide a footwear apparatus that supports waste reduction and consumer environmental stewardship when compared to the prior art as, according to the U.S Department of the Interior, Americans throw away over 300 million pairs of shoes annually.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE SEVERAL VIEWS OF THE DRAWING(S)

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
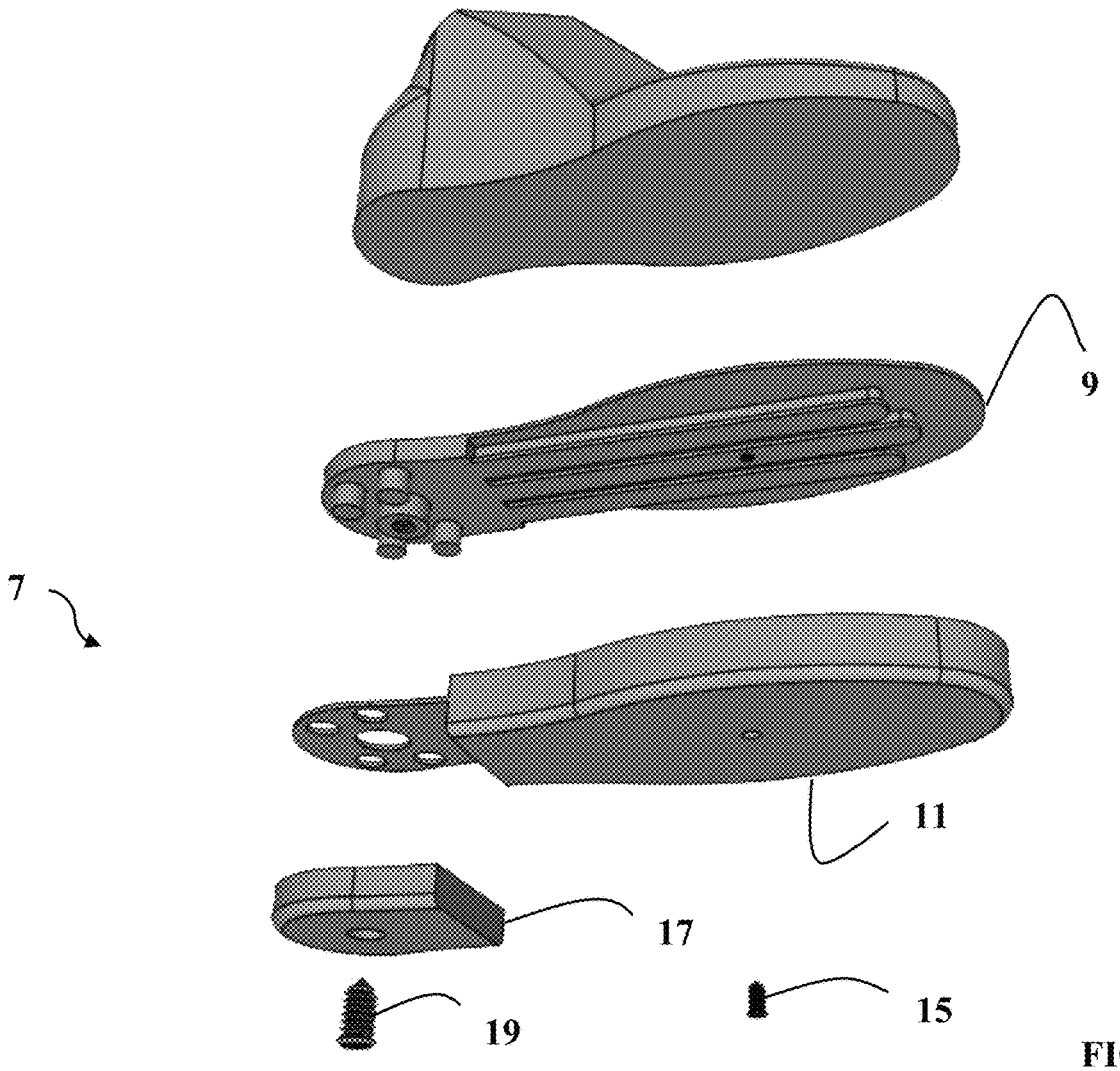
FIG. 1 is an exploded bottom perspective view of the present invention.

Turning now descriptively to the drawings, in which similar reference characters denote similar elements throughout the several views, FIGS. 1 through 4 illustrate a Chameleon Sole footwear apparatus 7, which comprises a base member 9 and at least one insert (principal insert 11 and/or heel insert 17) wherein said base member 9 can be attached to said insert(s) 11,17, having one or more fail-safe mechanisms 15, 19 to enhance interconnectivity of the base member 9 and insert(s) 11,17, and wherein said base member 9 is comprised of a configuration to fit or replace the sole or partial sole of a pair or pairs of footwear.

B. Base Member

The base member 9 is preferably comprised of a configuration to fit the sole of a shoe, pair of shoes or footwear as illustrated in FIG. 1.

The base member 9 includes one or more rails 21, one or more female threaded studs 27, possibly one or more standard studs 25, and a fail-safe locking mechanism #1 base hole 23 to accommodate fail-safe locking mechanism #1 15. The rail(s) 21 and stud(s) 27, 25 preferably attach the base member 9 to the principal insert 11.

The rail(s) 21 are included within the base member 9, and preferably extend latitudinally outward from the front or 'toe_edge of the base member 9.

The set of one or more female threaded studs 27 and possibly one or more standard studs 25 are included within the base member 9. If present, the standard studs 25 preferably are positioned in pairs longitudinally to the left and right edges of the 'heel_portion of the base member 9, such that the female threaded stud 27 is at the center of the standard stud 25 pair configuration.

The female threaded stud(s) 27 is included within the base member 9 and is positioned in a substantially longitudinal and latitudinal center of the 'heel_portion of the base member 9, such that the standard stud 25 pairs, if included, are equally distributed longitudinally to either side of the female threaded stud 27.

Figure 2:
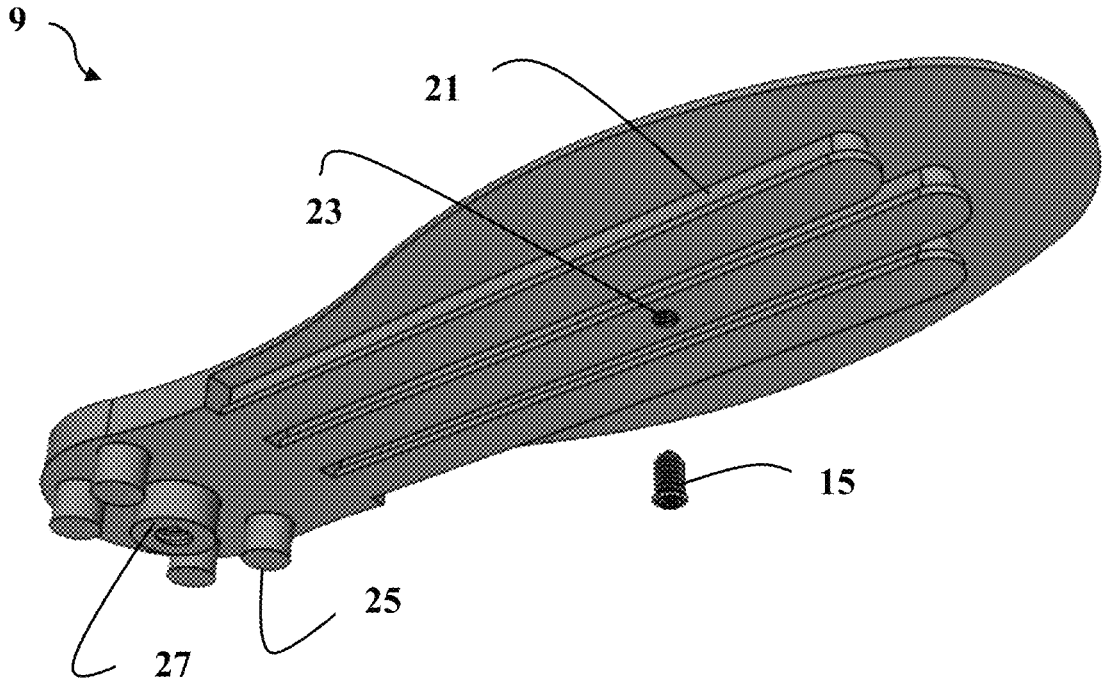
FIG. 2 is a bottom view of the base member and fail-safe locking mechanism #1 of the present invention.

The female threaded stud(s) 27 is preferably comprised of a substantially circular configuration as illustrated in FIG. 2; however the female threaded stud(s) 27 may be comprised of various other configurations, such as but not limited to rectangular and elliptical.

The fail-safe locking mechanism #1 base hole 23 to accommodate fail-safe locking mechanism #1 15 is positioned in a substantially longitudinal and latitudinal center of the rail(s) 21 portion of the base member 9, and preferably extends three fourths of the way through the base member 9. Preferably fail-safe locking mechanism #1 15 will be inserted into the holes 23, 33 present at the center of the rails 21, 31 on both the base member 9 and the principal insert 11 in order to interconnect them.

Fail-safe locking mechanism #1 15 is preferably comprised of a substantially circular, screw-shaped configuration as illustrated in FIG. 2; however fail-safe locking mechanism #1 15 may be comprised of various other configurations, such as but not limited to rectangular and elliptical.

C. Principal Insert

Figure 3:
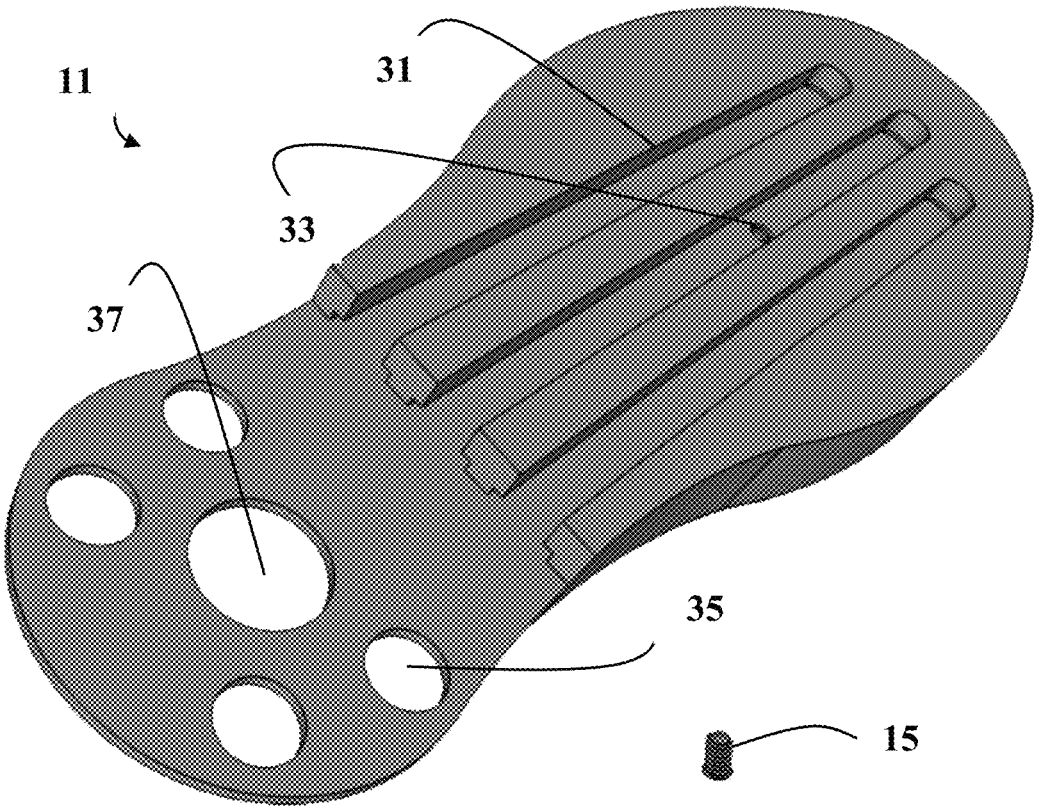
FIG. 3 is a top view of the principal insert and fail-safe locking mechanism #1 of the present invention.

The principal insert 11, if present, is preferably comprised of a footwear sole shaped configuration, as illustrated in FIG. 3, to allow it to interconnect with the base member 9.

The principal insert 11 constitutes one or more rails 31, a central opening 37 that securely fits the female threaded stud(s) 27 of the base member 9, possibly included subsidiary holes 35 that are the same quantity as the standard studs 25 in the base member 9 (if present) and of a size that allows the base member standard studs 25 to securely fit into these subsidiary holes 35.

The rail(s) 31 are included within the principal insert 11, and preferably extend latitudinally outward from the front or 'toe_edge of the principal insert 11.

The subsidiary holes 35, if present, extend through the principal insert 11, and preferably are positioned in pairs longitudinally to the left and right edges of the 'heel_portion of the principal insert 11, such that the central opening 37 is at the center of the pair configuration.

The central opening 37 extends through the principal insert 11 and is positioned in a substantially longitudinal and latitudinal center of the 'heel_portion of the principal insert 11, such that the subsidiary holes 35, if present, are equally distributed longitudinally to either side of the central opening.

The central opening 37 is preferably comprised of a substantially circular configuration as illustrated in FIG. 3; however the central opening 37 may be comprised of various other configurations, such as but not limited to rectangular and elliptical.

The fail-safe locking mechanism #1 insert hole 33 to accommodate fail-safe locking mechanism #1 15 is positioned in a substantially longitudinal and latitudinal center of the rail(s) 31 portion of the principal insert 11. Preferably fail-safe locking mechanism #1 15 will be inserted into the holes 33, 23 present at the center of the rails 31, 21 starting with the principal insert 11 and up through the base member 9 in order to interconnect them.

D. H eel Insert

Figure 4:
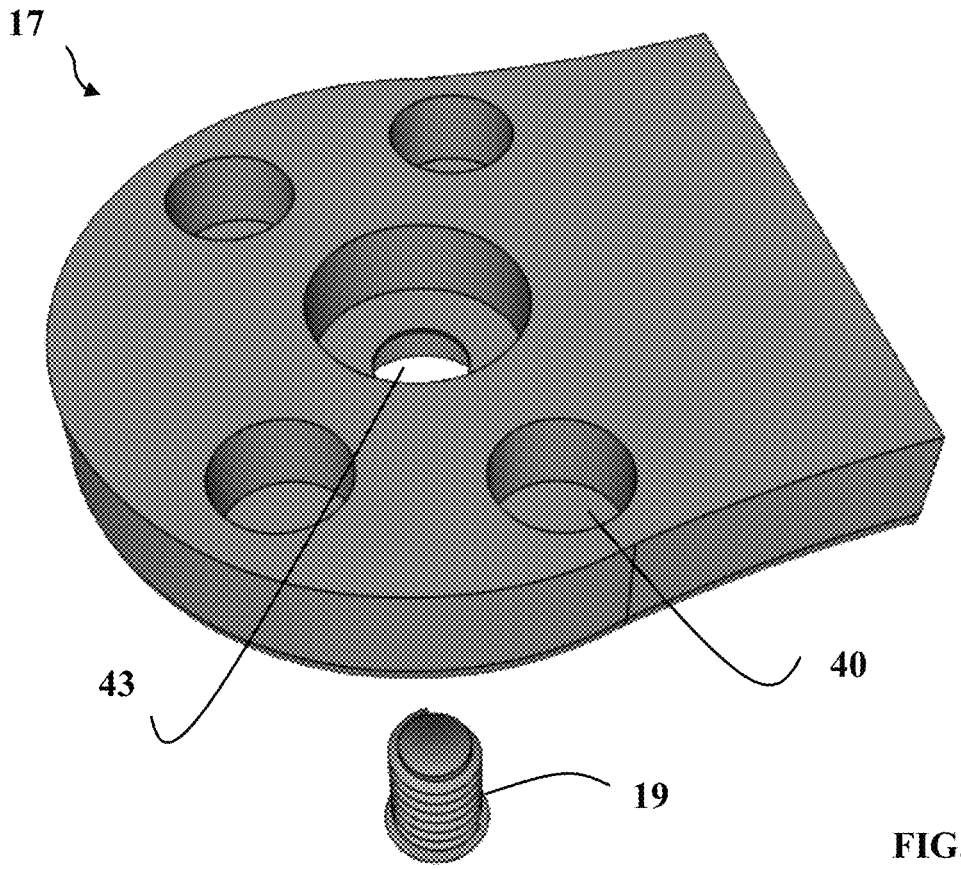
FIG. 4 is a top view of the heel insert and fail-safe locking mechanism #2 of the present invention.

The heel insert 17, if present, is preferably comprised of a footwear sole heel shaped configuration, as illustrated in FIG. 4, to allow it to interconnect with the back 'heel_portion of the principal insert 11 and/or base member 9.

The heel insert 17 constitutes a fail-safe locking mechanism #2 19, a fail-safe locking mechanism #2 hole 43, and possibly included one or more sockets 40 that are the same quantity as the standard studs 25 (if present) in the base member 9 and of a size that allows the base member standard studs 25 to securely fit into these socket(s) 40.

The fail-safe locking mechanism #2 hole 43 is positioned in a substantially longitudinal and latitudinal center of the heel insert 17. Preferably fail-safe locking mechanism #2 19 will be inserted into the fail-safe locking mechanism #2 hole 43 of the heel insert 17, allowing it to interconnect with the base member 9 and/or principal insert 11.

E. In Use

In use, the base member 9 is either pre-attached to a new shoe(s) or fitted onto the sole of an existing shoe(s) or pair of footwear. The user then slides the principal insert 11 onto the base member 9, locking it with fail-safe locking mechanism #1 15. Finally, the user pushes the heel insert 17 from below to fit it into the principal insert 11, and strengthens the interconnectivity of the heel insert 17 with fail-safe locking mechanism #2 19.

One of the many possible variations within the scope of the present invention is for a user to select a partial, as opposed to complete, sole replacement, which would potentially minimize the need to employ one or both of the aforementioned inserts.

Another possible variation within the scope of the present invention is for a person to use the Chameleon Sole footwear apparatus on an existing pair of shoes, detaching the existing sole and attaching the base member 9 using a method included but not limited to adhesive or stitching, and one or more inserts 11,17.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A footwear sole apparatus, comprising:

a base member that includes a toe portion, midfoot portion, and a heel portion: and an insert extending from a toe portion to a heel portion, the base member being configured to attach to the insert wherein said base member can be attached to said insert(s), the base member includes:

a first rail that protrudes from the base member, the first rail including an edge that protrudes from the first rail, the first rail extending along a longitudinal axis of the base member and extending continuously from the toe portion through the midfoot portion to the heel portion; and a cylindrical stud protruding from the heel portion: and the insert includes:

a second rail extending continuously from the toe portion through the midfoot portion to the heel portion that includes a groove along an outer edge of the second rail, the first rail of the base member is configured to slide into the second rail of the insert such that edge of the first rail contacts the groove of the second rail: and a circular opening configured to receive the cylindrical stud.

2. The footwear sole apparatus of claim 1, wherein the circular opening of the insert is provided on a center portion of a heel portion of the insert.

3. The footwear sole apparatus of claim 1, wherein the stud extends up to three quarters of a thickness of the base member and extends entirely through a thickness the insert.

4. The footwear sole apparatus of claim 1, wherein the insert is a principal insert and the apparatus further comprising a heel insert configured to overlap the heel portion of the base member.

5. The footwear sole apparatus of claim 4, further comprising a first fail-safe mechanism configured to reinforce a connection between the principal insert and the base member, and a second fail-safe mechanism configured to reinforce a connection between the heel insert and the base member.

6. The footwear sole apparatus of claim 5, wherein the stud extends entirely through a thickness of the heel insert.

7. The footwear sole apparatus of claim 1, wherein the stud is a female threaded stud.

8. The footwear sole apparatus of claim 4, wherein the principal insert includes a central opening that is configured to securely receive the stud of the base member.

9. The footwear sole apparatus of claim 8, wherein:

the principal insert includes a plurality of subsidiary holes, and the base member includes a corresponding number of studs that are configured to fit securely into the plurality of subsidiary holes.

10. The footwear sole apparatus of claim 4, wherein the heel insert includes a central opening that is configured to securely receive the stud of the base member.

11. The footwear sole apparatus of claim 10, wherein:

the heel insert includes a plurality of subsidiary holes, and the base member includes a corresponding number of studs that are configured to fit securely into the plurality of subsidiary holes.

12. A footwear system comprising:

a footwear including a bottom portion;

a base member that includes a toe portion, a midfoot portion, and a heel portion; and an insert, the base member being configured to attach to the insert, wherein: the base member is configured to fit onto the bottom portion of the footwear;

the base member includes:

a first rail that protrudes from the base member, the first rail including an edge that protrudes from the first rail, the first rail extending along a longitudinal axis of the base member and extending continuously from the toe portion through the midfoot portion to the heel portion; and a cylindrical stud;

and the insert includes:

a second rail extending continuously from the toe portion through the midfoot portion to the heel portion that includes a groove along an outer edge of the second rail, the first rail of the base member is configured to slide into the second rail of the insert such that edge of the first rail contacts the groove of the second rail; and a circular opening configured to receive the cylindrical stud.

13. The footwear system of claim 12, wherein the footwear includes an existing sole, the base member being configured to replace the existing sole and to fit onto the wearable portion.

14. A footwear insert comprising:

a principal insert including a rail that defines a groove along an outer edge of the rail, a base member configured to slide into the groove of the principal insert and including a cylindrical stud, the principal insert including a toe portion, midfoot portion and a heel portion, wherein:

the rail extends longitudinally along the toe portion and extends continuously from the toe portion through the midfoot portion to the heel portion, and the heel portion includes a circular opening configured to receive a cylindrical stud of the base member.

15. The footwear insert of claim 14, further comprising a heel insert being configured to overlap the heel portion of the principal insert.

16. A method of making footwear using the system of claim 12, comprising the steps of:

attaching the base member to the bottom portion of the footwear.

17. A method of making footwear using the system of claim 12, the footwear further including a sole, the method comprising the steps of:

removing the sole from the bottom portion of the footwear; and attaching the base member to the bottom portion of the footwear.

* * * * *